US009528513B2

(12) United States Patent
Chaudhari et al.

(10) Patent No.: US 9,528,513 B2
(45) Date of Patent: Dec. 27, 2016

(54) METHOD FOR HANDLING VARIABLE LENGTH PLUMBING NEEDS ON AN ELECTRICAL SUBMERSIBLE PUMP TEST BENCH

(71) Applicant: HALLIBURTON ENERGY SERVICES, INC., Houston, TX (US)

(72) Inventors: Hitendra Prakash Chaudhari, Houston, TX (US); Stewart Darold Reed, Spring, TX (US); Franklin Dale Henson, Friendswood, TX (US); Ariful Islam Bhuiyan, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/786,824

(22) PCT Filed: Aug. 12, 2014

(86) PCT No.: PCT/US2014/050647

§ 371 (c)(1),
(2) Date: Oct. 23, 2015

(87) PCT Pub. No.: WO2016/024950

PCT Pub. Date: Feb. 18, 2016

(65) Prior Publication Data

US 2016/0273530 A1 Sep. 22, 2016

(51) Int. Cl.
*F04B 51/00* (2006.01)
*F04D 15/00* (2006.01)

(52) U.S. Cl.
CPC ..... *F04B 51/00* (2013.01); *F04D 15/0088* (2013.01)

(58) Field of Classification Search
CPC ..... F04B 51/00
(Continued)

(56) References Cited

U.S. PATENT DOCUMENTS 2,145,401 A * 1/1939 MacBride ..... F02D 33/003 33/607
2,172,095 A * 9/1939 White ..... F04D 15/0088 73/113.01

(Continued)

FOREIGN PATENT DOCUMENTS

CN 201050474 Y 4/2008
CN 102518583 A 6/2012

(Continued)

OTHER PUBLICATIONS

International Search Report and Written Opinion issued in related PCT Application No. PCT/US2014/050647 mailed May 11, 2015, 10 pages.

*Primary Examiner* — Laura Martin
*Assistant Examiner* — Herbert K Roberts
(74) *Attorney, Agent, or Firm* — John W. Wustenberg; Baker Botts L.L.P.

(57) ABSTRACT

A submersible pump test bench capable of testing multiple lengths of submersible pumps. The test bench includes a series of trolleys that may be moved along, added to, or removed from a rail depending on the length of submersible pump to be tested. The test bench further includes a hose handler for redirecting a length of hose connecting the submersible pump to a broader hydraulic circuit. In certain embodiments, the hose handler includes a rotating sheave or similar structure that redirects the hose back on itself, providing a length-multiplying effect.

20 Claims, 5 Drawing Sheets

(58) Field of Classification Search
USPC ..... 73/168
See application file for complete search history.

(56) References Cited

U.S. PATENT DOCUMENTS 2,185,943 A * 1/1940 Hartridge ..... 73/168
2,306,461 A * 12/1942 Miller ..... F02M 59/14 29/257
2,566,742 A * 9/1951 Odell ..... F02D 33/003 73/114.41
2,612,777 A * 10/1952 Greer ..... F04D 15/0088 73/168
2,826,067 A * 3/1958 Braunlich ..... F04D 15/0088 73/168
3,098,382 A * 7/1963 Hoffman ..... F15B 19/002 73/1.21
3,245,254 A * 4/1966 Mayer ..... G01F 9/006 73/114.41
3,350,934 A * 11/1967 Orkney, Jr. ..... F04D 15/0088 73/168
3,395,575 A * 8/1968 Emerson ..... F02M 65/002 73/114.41
3,839,627 A * 10/1974 Grant ..... F02M 65/00 377/2
3,942,375 A 3/1976 Shepherd
4,114,426 A * 9/1978 McLean ..... G01M 3/30 73/168
4,502,319 A * 3/1985 Arens ..... G01F 13/00 73/1.27
4,798,086 A * 1/1989 Styfhoorn ..... F04B 51/00 73/168
5,048,330 A * 9/1991 Link, Jr. ..... G01M 99/00 73/168
5,272,909 A * 12/1993 Nguyen ..... A61F 2/2472 600/481
5,339,677 A * 8/1994 Haug ..... G01N 3/12 73/37
5,499,530 A * 3/1996 Vondell ..... G01M 13/00 415/118
5,742,519 A * 4/1998 McClendon ..... A61M 5/142 702/114
6,021,667 A * 2/2000 Gellerson ..... F15B 19/00 73/168
6,125,868 A * 10/2000 Murphy ..... F16K 31/46 137/1
6,260,004 B1 * 7/2001 Hays ..... G05B 23/0235 702/130
6,862,940 B2 * 3/2005 Romano ..... G01N 3/10 73/168
7,017,406 B1 * 3/2006 Cressman ..... F04B 51/00 73/168
2002/0157468 A1 * 10/2002 Hille ..... G01N 1/2035 73/592
2003/0078751 A1 * 4/2003 Juhasz ..... B01D 46/44 702/114
2003/0097232 A1 * 5/2003 McClendon ..... A61M 5/142 702/114
2005/0109099 A1 * 5/2005 Seys ..... B05B 12/00 73/168

FOREIGN PATENT DOCUMENTS

CN 202994495 U 6/2013
EP 2136078 A1 12/2009

* cited by examiner

METHOD FOR HANDLING VARIABLE LENGTH PLUMBING NEEDS ON AN ELECTRICAL SUBMERSIBLE PUMP TEST BENCH

CROSS-REFERENCE TO RELATED APPLICATION

The present application is a U.S. National Stage Application of International Application No. PCT/US2014/050647 filed Aug. 12, 2014, which is incorporated herein by reference in its entirety for all purposes.

BACKGROUND

Electrical submersible pumps (ESPs) may be used by oil and gas well operators when reservoir pressure alone is insufficient to efficiently produce from a well. ESPs are installed on the end of a tubing string and are inserted into the completed wellbore, below the level of reservoir fluids. ESPs employ a centrifugal pump driven by an electric motor to draw reservoir fluids into the pump, through the tubing string, and to the surface.

Depending on pressure and flow requirements, the ESP may contain multiple sets of blades or impellers arranged in multiple pump stages. As a result of this variation in blade and impellor arrangements, ESPs can vary significantly in length. For example, small ESPs may only be a few feet long while larger ESPs can extend several dozen feet.

Testing of ESPs typically involves mounting the pump on a test bench having a suitable drive, connecting the pump to a hydraulic circuit, and then running the drive to operate the ESP and circulate fluid through the hydraulic circuit. As the ESP operates, flow, pressure, and other measurements are collected to verify the ESP is operating as designed.

Testing different length ESPs requires either multiple test benches configured for different ESP lengths, or a test bench and associated hydraulic piping that can be reconfigured to accommodate variations in ESP length. If the hydraulic circuit contains rigid pipe or other inflexible components, reconfiguration may require time-consuming addition or removal of hydraulic circuit components, leading to undesirable labor costs and down-time of the test bench. Alternatively, expensive movable fittings, such as swivel-type pipe joints, may be installed in the hydraulic circuit and on the test bench to allow repositioning of the components to accommodate varying pump lengths. These types of fittings can be cost-prohibitive.

Accordingly, there is a need for an ESP test bench that can readily accommodate varying lengths of ESPs with minimal downtime required to reconfigure the test bench for different ESP lengths.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to test benches for testing electrical submersible pumps (ESPs).

Illustrative embodiments of the present invention are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time consuming, but would nevertheless be a routine undertaking for those of ordinary skill in the art having the benefit of the present disclosure.

To facilitate a better understanding of this disclosure, the following examples of certain embodiments are given. In no way should the following examples be read to limit, or define, the scope of the claims.

Figure 1:
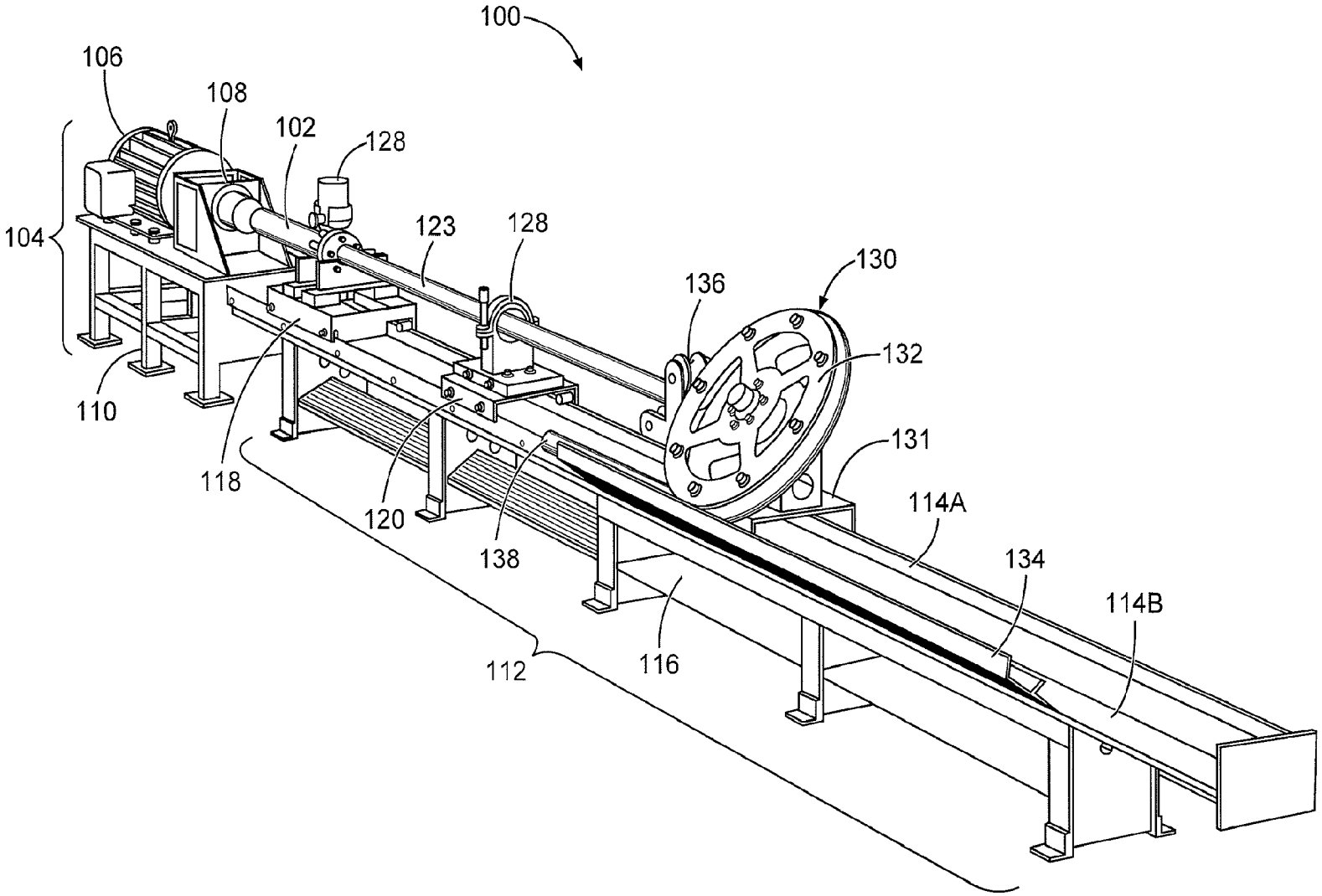
FIG. 1 is an isometric view of a test bench according to a first embodiment

FIG. 1 depicts a first embodiment of a test bench 100 in which an ESP 102 is mounted on the test bench 100 and connected to a drive assembly 104. In general, the drive assembly 104 includes a motor 106 for driving the ESP 102. A transmission 108 may be used to transmit power from the motor 106 to the ESP 102. The transmission may also include other components such as a gearbox for modifying speed and torque output of the motor 106 and bearings or couplings designed to mitigate or distribute forces generated by the ESP 102 during testing. The drive assembly 104 may also include a fluid inlet (not depicted) for connecting the test bench 100 to a hydraulic circuit or fluid source. As depicted, drive assembly 104 also includes a frame 110 for supporting the drive assembly components.

Adjacent to the drive assembly 104 is a rail assembly 112. The rail assembly 112 includes a support frame 116 and a pair of rails 114A, 114B. Although the embodiment in FIG. 1 depict a test bench having a pair of rails, other embodiments may include any number of rails including a single rail. Each rail may comprise a single rail piece, multiple rail pieces coupled together, or a series of disconnected collinear rail segments.

A set of movable trolleys are disposed on the rails 114A, 114B. For the embodiment in FIG. 1, these trolleys include a pump fixture trolley 118 and a support fixture trolley 120. The pump fixture trolley 118 supports a distal end of the ESP 102 when the ESP 102 is mounted on the test bench 100 and provides a location to couple the ESP 102 to a hose 123.

As depicted, the ESP 102 is connected to the hose 123 by a flanged connection 124 including a back pressure valve 126 for maintaining back pressure on the ESP 102 during testing. The connection between ESP 102 and the hose 123 may comprise other connection types including but not limited to threaded connections, hose clamps, quick-connect-style fittings, or any other suitable method of connecting the hose 123 to ESP 102.

Support fixture trolleys, such as support fixture trolley 120, may be disposed along the rails 114A, 114B to support either the ESP 102 or the hose 123. Depending on the length of the ESP being tested, support fixture trolleys may be repositioned on, added to, or removed from the rails. In FIG. 1, the support fixture trolley 120 includes a support 128. The support further comprises a retainer, depicted in FIG. 1 as a pipe clamp. Other types of retainers, such as cradles, hose clamps, or chain clamps, may also be used to receive the ESP 102 or hose 123. The support 128 may comprise an elastomeric or other type of lining to protect the hose and ESP, provide shock absorbance, or better retain the hose 123 and ESP 102.

To accommodate different ESP sizes and arrangements, the pump fixture trolley 118 and support fixture trolley 120 are movable along the rails 114A, 114B. Movement along the rails 114A, 114B may be accomplished by, for example, linear bearings or rail wheels installed on the underside of the trolleys and configured to mate with the rails 114A, 114B. Alternatively, the rails may include low-friction guides or coatings that permit sliding of the trolleys along the rails.

Generally, a given trolley will be prevented from significant movement along the rail by virtue of the weight of the ESP, hose, and the trolley itself. However, any trolley may also include braking mechanisms such as clamps, set screws, discs, pins, or similar devices that, when engaged, prevent movement of the trolley along the rails 114A, 114B. In addition to or as an alternative to being movable along the rails, each trolley may be entirely removable from the rails. As a result, trolleys can be added, removed, or reordered depending on the specific ESP being tested.

According to the embodiment of FIG. 1, a hose handler 130 is also disposed on the rails 114A, 114B. The hose handler 130 comprises a rotatable sheave 132 and a hose guide 136 mounted on a movable hose handler trolley 131. When an ESP is placed on the test bench and made ready for testing, the hose 123 runs in a first direction from the connection 124 to the hose guide 136. The hose guide 136 directs the hose onto the rotatable sheave 132. The hose 123 wraps around the rotatable sheave 132 and into a hose tray 134 adjacent to the rail 114. Once in the hose tray 134, the hose runs in a second direction that is parallel to but in the opposite direction of the first direction.

A hose outlet 138 of the hose 123 is positioned at the end of the hose tray 134. In some embodiments, clamps, ties, bands, or other means are used to secure the outlet 138 to the hose tray 134 or to another portion of the test bench 100, fixing the position of the hose outlet 138. The outlet 138 may be connected to other equipment including meters and sensors for measuring properties of fluid exiting the hose outlet 138, filters or separators for removing particulates from the fluid, coolers or heat exchangers for cooling the fluid, or any other equipment for measuring, treating, storing, or directing fluid flow. In any embodiment, the connected piping and equipment may redirect fluid flow back to the fluid inlet of the test bench.

As depicted in FIG. 1, the hose handler 130 is movable along the rails 114A, 114B. Similar to the previously discussed pump fixture trolley 118 and support fixture trolley 120, movement of the hose handler 130 along the rails 114A, 114B may be accomplished in various ways. For example, linear bearings or rail wheels may be installed on the underside of the hose handler trolley 131. Alternatively, the rails 114A, 114B may include low-friction guides or coatings that permit sliding of the hose handler trolley 131 along the rails 114A, 114B.

In any embodiment, the hose handler 130 may be configured to be manually movable along the rails 114A, 114B or may be moved by a drive mechanism. The drive mechanism may operate based on electric, hydraulic, pneumatic, mechanical or other types of power. For example, the hose handler 130 may be movable by a motor and system of gears, belts, or cable pulls or may be movable by a linear pneumatic actuator.

To facilitate a better understanding of this disclosure, a description of use of a test bench in accordance with this disclosure follows. This description should not be read to limit, or define, the scope of the claims. For example, the example that follows should not limit the lengths of ESPs suitable for testing despite the example referring to ESPs having specific lengths.

Figure 2A:
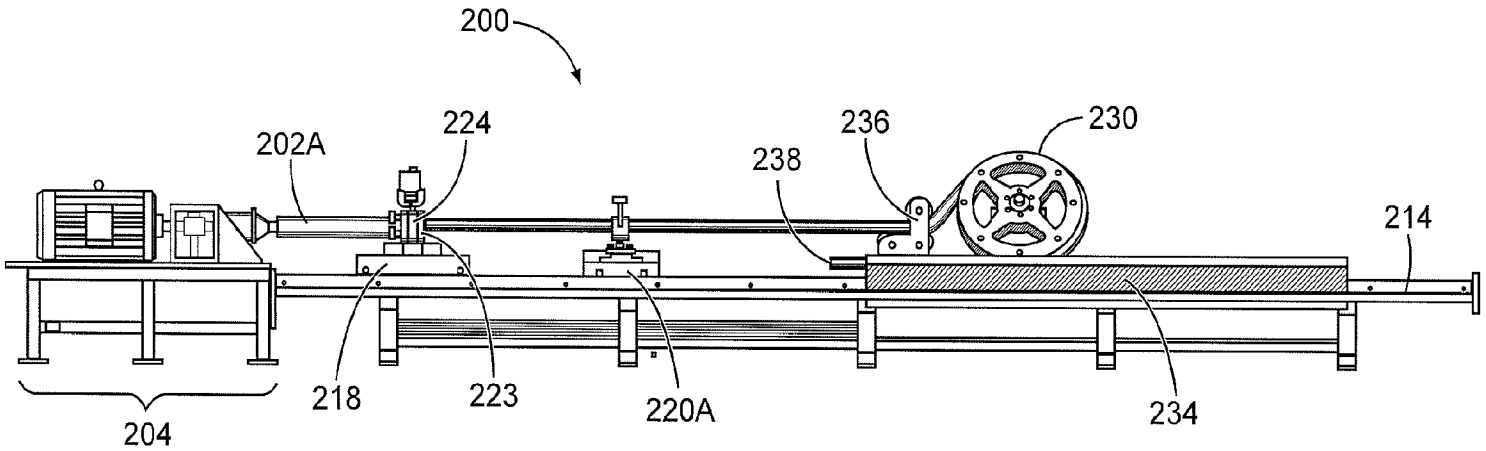
FIG. 2A is a side view of a test bench in accordance with a second embodiment and configured for a first ESP.

FIG. 2A depicts a test bench 200 according to one embodiment. An ESP 202A is mounted on the test bench 200 and connected to a drive assembly 204. For purposes of this example only, submersible pump 202A has a total length of 4 ft. Prior to mounting ESP 202A, the test bench 200 is configured to accommodate the specific length of ESP to be tested. In the case of ESP 202A the test bench is configured by positioning a pump fixture trolley 218 and a support fixture trolley 220A along a rail 214 such that the pump fixture trolley 218 and support fixture trolley 220A support ESP 202A and a hose 223, respectively.

In addition to adjusting the position of the pump fixture trolley 218 and the support fixture trolley 220A, a hose handler 230 is moved into position along the rail 214. Specifically, the hose handler 230 is positioned such that when ESP 202A is mounted on the test bench, hose 223 runs in a first direction from a pump connection 224 and passes through a hose guide 236 that directs the hose 223 onto a rotating sheave 232. The hose 223 is directed around the rotating sheave 232 and then along a hose tray 236 in a second direction opposite to the first direction. At the end of the hose tray 236, a hose outlet 238 is located and may be fixed as previously discussed in this disclosure. As depicted in FIG. 2A, the support fixture 220A is positioned to support the hose 223.

After positioning pump fixture trolley 218, support fixture trolley 220A, and hose handler 230, ESP 202A may be mounted on the test bench 200 and coupled to the drive assembly 204 and pump connection 224. Once mounted, ESP 202A can be driven by the drive assembly 204 to pump fluid from an inlet (not depicted), through the ESP 202A and the hose 223, and out of the hose outlet 238. As previously discussed, the inlet and hose outlet may connect to a larger hydraulic system including equipment for measuring properties of the fluid as it enters and exits the pump, for cooling and filtering the fluid, or for various other functions related to testing the pump or processing the fluid.

When testing is complete, ESP 202A may be decoupled from the drive assembly 204 and the pump connection 224 and removed from the test bench 200. After removal of the ESP 202A, the test bench 200 can be used as-configured to test another ESP of the same length as ESP 202A or can be reconfigured to test an ESP of a different length.

Figure 2B:
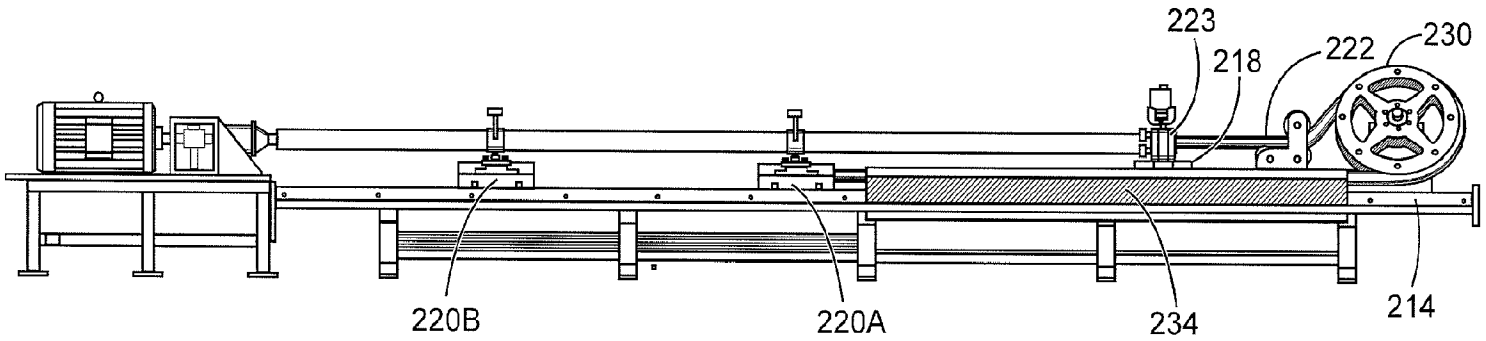
FIG. 2B is a side view of the test bench of FIG. 2A configured for a second ESP having a different length than the ESP of FIG. 2A.

FIG. 2B depicts the test bench 200 reconfigured to accommodate a second ESP 202B. For purposes of this example only, ESP 202B has a length of 24 ft., i.e., 20 ft. longer than ESP 202A.

To accommodate ESP 202B, the test bench 200 is reconfigured by adjusting the number and placement of support fixture trolleys and repositioning the pump fixture trolley and hose handler. Specifically, pump fixture trolley 218 is moved along the rail 214 to a position corresponding to the end of ESP 202B. Similarly, support fixture 220A is moved along the rail 214 such that support fixture trolley 220A directly supports ESP 202B instead of hose 223, as was the case in the configuration depicted in FIG. 2A. A second support fixture trolley 220B has also been added onto the rail 214 to provide additional support for the ESP 202B.

The hose handler 230 is also been repositioned along the rail 214 to accommodate ESP 202B. Repositioning the hose handler 230 along the rail 214, directs a greater proportion of the hose 223 along the hose tray 234 than in the configuration depicted in FIG. 2A. In the embodiments of FIGS. 2A and 2B, the hose handler 230 acts as a length multiplier by redirecting the hose 223 back on itself. As a result, accommodating a difference between ESP lengths of one unit of length requires moving the hose handler 230 only half a unit of length. With respect to the specific example illustrated in FIGS. 2A and 2B, accommodating the 20 ft. difference between ESP 202A and ESP 202B requires moving the hose handler 230 only 10 ft.

Figure 3:
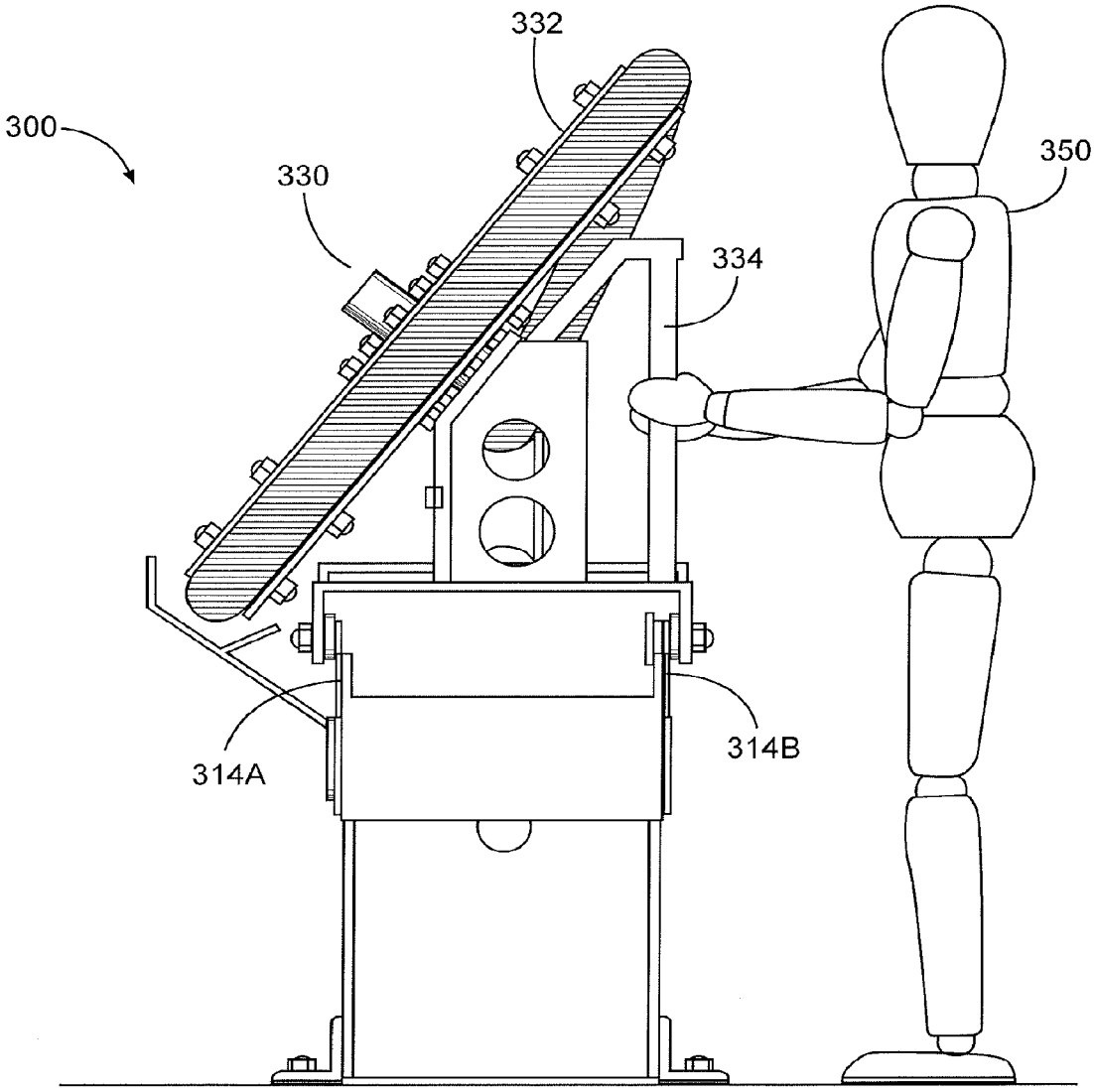
FIG. 3 is an end view of a test bench in accordance with an embodiment having a tilted rotating sheave.

FIG. 3 is an end view of a test bench 300 according to one embodiment in which an operator 350 is depicted moving the hose handler 330. Similar to the hose handlers and sheaves of FIGS. 1, 2A, and 2B, the rotating sheave 332 of hose handler 330 is depicted in FIG. 3 as being tilted. In such a configuration, the hose handler 330 may redirect the hose along a path adjacent to the rails, along a hose tray 316. The hose handler 320 may also include handles 334 for facilitating movement of the hose handler 330.

Figure 4:
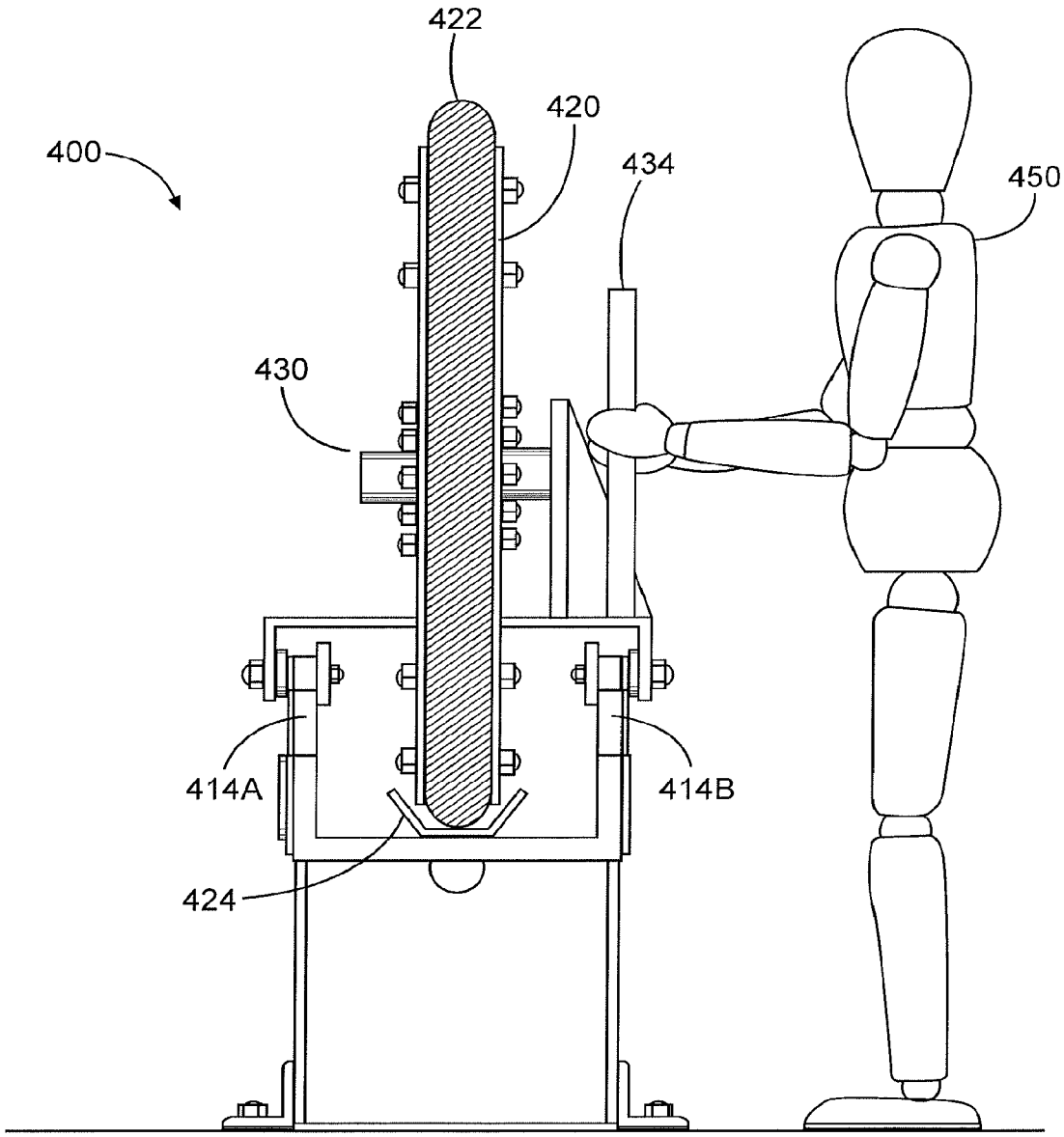
FIG. 4 is an end view of a test bench in accordance with an embodiment having a vertical rotating sheave.

Other embodiments may have alternate arrangements of the sheave. For example, FIG. 4 is an end view of a test bench 400 having a hose handler 420 that includes a vertical sheave 420. In the vertical orientation, the hose handler 420 redirects the hose 422 along a trough located between rails 414A and 414B. A hose tray 424 may also be located between the rails to retain and support the hose 422. Similar to FIG. 3, the hose handler 420 may include one or more handles 434 for facilitating movement of the hose handler 420 by an operator 450.

Figure 5:
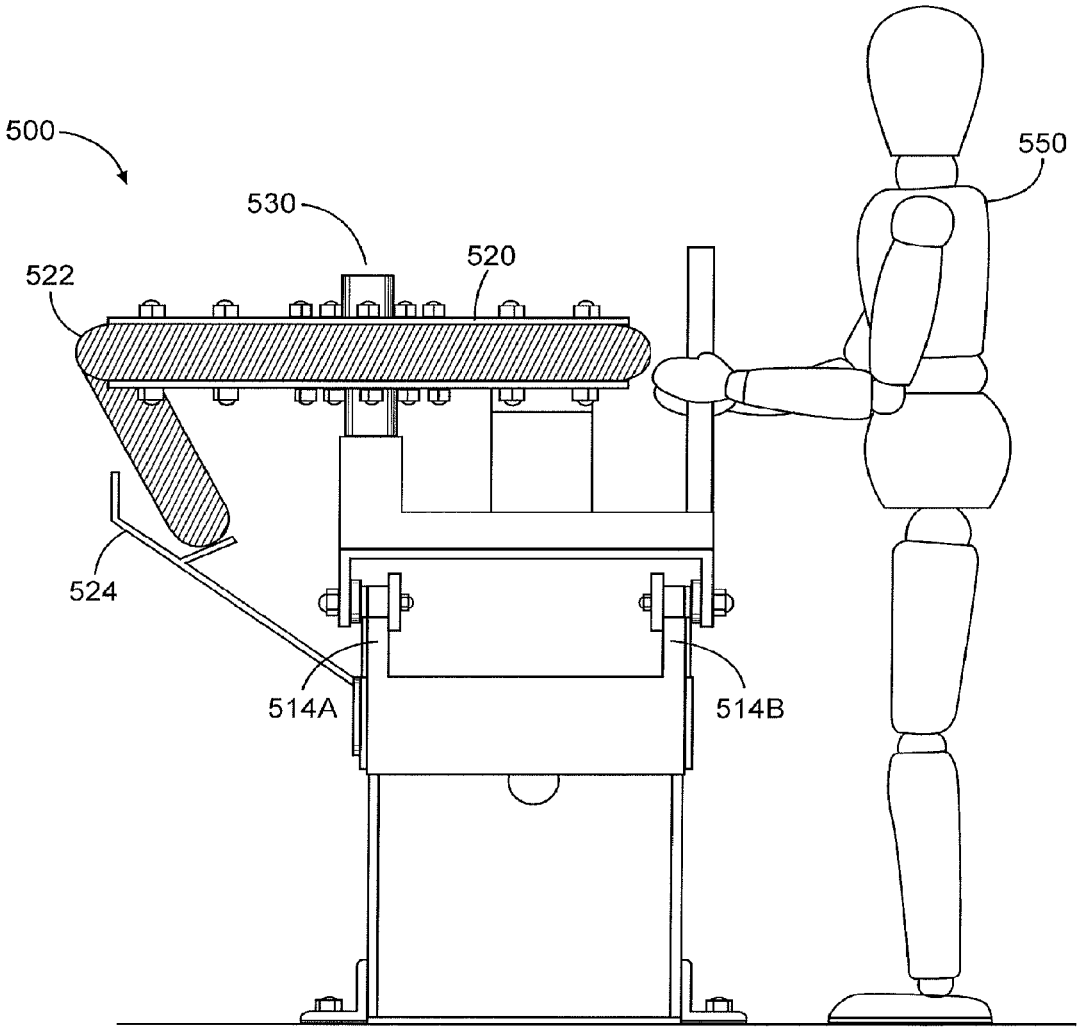
FIG. 5 is an end view of a test bench in accordance with an embodiment having a horizontal rotating sheave.

FIG. 5 depicts an embodiment in which the hose handler 520 comprises a horizontally mounted rotating sheave 520. In a horizontal arrangement, accommodating handles 534 while maintaining proper alignment of the hose 522, may require the rotating sheave 520 to be mounted eccentrically. For example, in FIG. 5, rotating sheave 520 is centered over rail 514A.

Although the hose handler of previously discussed embodiments have each included a rotating sheave for redirecting the hose, other embodiments may include other arrangements suitable for redirecting the hose. For example, instead of the rotating sheave, the hose handler may include a rotatable hose reel and the hose may wrap multiple times around the hose reel. The hose reel may be spring driven such that the hose is self-retracting. The hose reel may also include a handle, crank, or motor for rotating the hose reel.

Embodiments may also include hose handlers having multiple connected hose reels. For example, a first hose reel may be used to adjust the length of hose between the ESP and the hose handler, while a second hose reel may be used to adjust the length of hose between the hose handler and the location of the hose outlet. In such an arrangement, the hose may include two separate hose sections corresponding to the first hose reel and the second hose reel, the two separate sections being connected to permit fluid flow between the two hose sections and to permit independent rotation of the first and second hose reels.

Although numerous characteristics and advantages of embodiments of the present invention have been set forth in the foregoing description and accompanying figures, this description is illustrative only. Changes to details regarding structure and arrangement that are not specifically included in this description may nevertheless be within the full extent indicated by the claims.

What is claimed is:

1. A submersible pump test bench comprising:
a rail;
a hose;
a fluid discharge outlet comprising a first end of the hose;
a pump fixture trolley disposed on the rail, the pump fixture trolley comprising a coupling for connecting a submersible pump to a second end of the hose; and
a hose handler disposed on the rail, the hose handler being configured to support the hose;
wherein the pump fixture trolley and the hose handler are repositionable on the rail to accommodate different lengths of submersible pumps.

2. The submersible pump test bench of claim 1, wherein the first end of the hose is fixed at the fluid discharge outlet.

3. The submersible pump test bench of claim 1, further comprising
at least one support fixture trolley disposed on the rail.

4. The submersible pump test bench of claim 1, wherein the hose handler comprises a rotating sheave.

5. The submersible pump test bench of claim 1, wherein the hose handler comprises at least one hose reel.

6. The submersible pump test bench of claim 1, wherein the hose follows a first hose path between the pump connection and the hose handler and the hose follows a second hose path between the hose handler and the discharge outlet, the second hose path being partially parallel to the first hose path.

7. The submersible pump test bench of claim 1, wherein the hose at least partially extends along a hose tray.

8. The submersible pump test bench of claim 1, wherein the rail comprises a plurality of rail segments.

9. The submersible pump test bench of claim 1, wherein the hose handler further comprises at least one handle for movement of the hose handler along the rail by an operator.

10. The submersible pump test bench of claim 1, wherein the hose handler is movable by a drive mechanism.

11. The submersible pump test bench of claim 1, wherein at least one of the pump fixture trolley and the hose handler comprise a brake for preventing movement of the at least one of the pump fixture trolley and the hose handler along the rail.

12. The submersible pump test bench of claim 1, wherein the pump fixture trolley further comprises a back-pressure valve for maintaining back pressure on a submersible pump during testing.

13. The submersible pump test bench of claim 1, further comprising
at least one sensor for measuring performance of a submersible pump during testing.

14. A method for testing submersible pumps on a submersible pump test bench, the method comprising positioning a pump fixture trolley and a hose handler on a rail of the submersible test bench to accommodate a first submersible pump, the pump fixture trolley comprising a coupling for connecting a hose to the first submersible pump;

connecting a first end of a hose to a fluid discharge outlet and a second end of the hose to the coupling such that at least a portion of the hose is supported by the hose handler;

mounting the first submersible pump on the submersible pump test bench such that a discharge of the first submersible pump connects to the coupling;

removing the first submersible pump from the submersible pump test bench; and reconfiguring the submersible pump test bench to accommodate a second submersible pump test bench;

wherein reconfiguring the submersible pump test bench comprises repositioning at least one of the pump fixture trolley and the hose handler on the rail to receive a second submersible pump having a different length than the first submersible pump.

15. The method of claim 14, further comprising testing the first submersible pump by operating the first submersible pump.

16. The method of claim 14, further comprising positioning at least one support fixture trolley on the rail to support at least one of the first submersible pump and the hose.

17. The method of claim 16, wherein reconfiguring the submersible pump test bench further comprises repositioning the at least one support fixture trolley on the rail to accommodate the second submersible pump.

18. The method of claim 16, wherein reconfiguring the submersible pump test bench further comprises at least one of removing the at least one support fixture trolley from the rail and adding at least one additional support fixture trolley to the rail.

19. The method of claim 14, wherein the hose handler comprises a rotating sheave.

20. The method of claim 14, wherein the hose handler comprises at least one hose reel.

* * * * *